US009687075B2

(12) United States Patent
Weber

(10) Patent No.: US 9,687,075 B2
(45) **Date of Patent: *Jun. 27, 2017**

(54) BIASED MECHANISM FOR GUIDED INSERTION

(71) Applicant: CAREFUSION 303, INC., San Diego, CA (US)

(72) Inventor: Frank Dean Weber, San Diego, CA (US)

(73) Assignee: CareFusion 303, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/853,899

(22) Filed: Sep. 14, 2015

(65) Prior Publication Data

US 2016/0000224 A1 Jan. 7, 2016

Related U.S. Application Data

(63) Continuation of application No. 13/012,755, filed on Jan. 24, 2011, now Pat. No. 9,131,774.

(51) Int. Cl.
*A47B 88/18* (2006.01)
*A61J 1/16* (2006.01)
(Continued)

(52) U.S. Cl.
CPC ..... *A47B 88/18* (2013.01); *A47B 67/02* (2013.01); *A47B 81/00* (2013.01); *A47B 88/90* (2017.01);
(Continued)

(58) Field of Classification Search
CPC . A47B 88/20; A47B 88/0414; A47B 88/0477; G07F 17/0092; G07F 11/62;
(Continued)

(56) References Cited

U.S. PATENT DOCUMENTS 5,139,321 A 8/1992 Beardsley
5,393,137 A 2/1995 Bivens et al.
(Continued)

FOREIGN PATENT DOCUMENTS

CN 1511760 7/2004
DE 1778452 A1 * 10/1971 ..... A47B 88/16
(Continued)

OTHER PUBLICATIONS

European Communication under Rule 71(3) and Text as Proposed for Grant for Application No. 12739569.7, dated Apr. 6, 2016, 64 pages.
(Continued)

*Primary Examiner* — Andrew Roersma
(74) *Attorney, Agent, or Firm* — McDermott Will & Emery LLP

(57) ABSTRACT

A drawer assembly is disclosed that includes a removable container ad a receiving tray. The container has a housing having at least one shaped surface and at least one horizontal alignment element coupled to and projecting from the housing. The receiving tray has a base having a redirection feature and at least one horizontal alignment hole in the base that is configured to accept the horizontal alignment element. The container and receiving tray are configured such that downward motion of the container with the shaped surface of the housing in contact with the redirection feature of the base induces a lateral motion of the container according to the engagement of the shaped surface and the redirection feature that causes the horizontal alignment element to slide into the horizontal alignment hole.

20 Claims, 9 Drawing Sheets

(51) Int. Cl.

| | |
|---|---|
| ***G07F 17/00*** | (2006.01) |
| ***A47B 67/02*** | (2006.01) |
| ***A47B 81/00*** | (2006.01) |
| ***A47F 10/00*** | (2006.01) |
| ***A61J 1/00*** | (2006.01) |
| ***A47B 77/18*** | (2006.01) |
| ***A47B 88/90*** | (2017.01) |

(52) U.S. Cl.
CPC ..... *A47F 10/00* (2013.01); *A61J 1/00* (2013.01); *A61J 1/16* (2013.01); *G07F 17/0092* (2013.01); *A47B 77/18* (2013.01); *A47B 2067/025* (2013.01); *Y10T 29/49826* (2015.01)

(58) Field of Classification Search
CPC ..... Y10T 29/49826; Y10T 403/20; A61J 2203/46; A61J 2205/10; A61J 2205/30; A61J 7/0084; A61G 12/001; A61G 2205/10
USPC ..... 312/330.1, 308, 310, 302; 439/296, 131, 439/32; 361/679.4–679.45; 221/197
See application file for complete search history.

(56) References Cited

U.S. PATENT DOCUMENTS

| | | | | |
|---|---|---|---|---|
| 6,011,999 | A | 1/2000 | Holmes | |
| 6,116,461 | A * | 9/2000 | Broadfield | A61G 12/001 206/443 |
| 6,264,488 | B1 | 7/2001 | Helot et al. | |
| 6,301,106 | B1 | 10/2001 | Helot et al. | |
| 6,315,583 | B1 * | 11/2001 | Nishioka | G06K 13/0856 439/131 |
| 6,560,101 | B1 * | 5/2003 | Oross | G06F 1/1632 361/679.43 |
| 6,570,758 | B1 | 5/2003 | Maeda | |
| 7,630,789 | B2 * | 12/2009 | Broadfield | A61G 12/001 221/98 |
| 9,131,774 | B2 * | 9/2015 | Weber | A47B 88/20 |
| 2002/0131234 | A1 | 9/2002 | Sterner et al. | |
| 2005/0122010 | A1 | 6/2005 | Kobayashi et al. | |
| 2006/0061245 | A1 * | 3/2006 | Huber | A47B 88/0414 312/348.1 |
| 2007/0159040 | A1 | 7/2007 | Fernandez et al. | |
| 2008/0100189 | A1 * | 5/2008 | Huber | A47B 88/0414 312/319.1 |
| 2009/0108016 | A1 | 4/2009 | Brown et al. | |
| 2009/0204254 | A1 * | 8/2009 | Weber | G07F 11/62 700/215 |
| 2010/0281932 | A1 | 11/2010 | Artsiely | |
| 2012/0187815 | A1 | 7/2012 | Weber et al. | |

FOREIGN PATENT DOCUMENTS

| | | | |
|---|---|---|---|
| EP | 1621838 | A2 | 2/2006 |
| GB | 2359404 | A | 8/2001 |
| GB | 2461070 | A | 12/2009 |
| WO | WO-99/60982 | A2 | 12/1999 |

OTHER PUBLICATIONS

Chinese Office Action in Chinese Application No. 201110191692.9 dated Feb. 27, 2015, 5 pgs.
Extended European Search Report dated Jun. 4, 2014, which issued in European Application No. 12739569.7.
International Preliminary Report on Patentability and Written Opinion for PCT/US2012/022254 mailed Jul. 30, 2013, 6 pages.
International Search Report and Written Opinion for PCT/US2012/022254 mailed Jul. 31, 2012, 8 pages.
Chinese Office Action for Application No. 201110191692.9, dated Oct. 29, 2015, 8 pages.
Australian Patent Examination Report No. 1 for Application No. 2012209331, dated May 11, 2016, 3 pages.
Extended European Search Report for Application No. 16183734.9, dated Nov. 21, 2016, 9 pages.

* cited by examiner

BIASED MECHANISM FOR GUIDED INSERTION

RELATED APPLICATION

This application is a continuation of U.S. patent application Ser. No. 13/012,755, filed Jan. 24, 2011, entitled "Self-Guiding Insertion and Bias Mechanism," which is incorporated herein by reference in its entirety.

BACKGROUND

Field

The present disclosure generally relates to systems and methods of connecting removable electrical components and, in particular, relates to mechanisms that guide the motion of insertion of a removable container.

Description of the Related Art

Hospitals have a need to provide secure storage for certain medications such as narcotics and controlled substances while still making the medications available to care givers. One method of accomplishing this is to use lidded containers where the lid can only be opened when the container is connected to a power source and processor that can send the appropriate digital commands. The lidded container is filled with a medication in the pharmacy and the lid closed. While the container is transported to the local Automatic Dispensing Machine (ADM), the contents of the container are secure as the lid cannot be opened without breaking the container. The container is installed in the ADM which provides power and can send the commands to open the lid. The software of the ADM is set up to open the lid only after certain requirements are met, such as verification that the individual accessing the container is authorized to do so.

Providing a reliable connection between the container and the ADM requires that the container connector be held securely in position both vertically and horizontally. An electrical connection could be achieved between the container and tray with a simple vertical mating connector. However, some additional active latching scheme would be required to restrain the connector against vertical motions induced by shock and moments. The advantage of the approach in this invention is that the container is guided during vertical insertion so that the connector is restrained vertically and horizontally by passive features in the container and tray.

SUMMARY

The disclosed system includes a lidded container and a docking station that cooperate to guide the insertion of the lidded container into the docking station such that the lidded container engages retention features on the docking station that restrain the vertical motion of the container without requiring any additional space for lateral motion of the container during the insertion.

A drawer assembly is disclosed that includes a removable container and a receiving tray. The container has a housing having at least one shaped surface and at least one horizontal alignment element coupled to and projecting from the housing. The receiving tray has a base having a redirection feature and at least one horizontal alignment hole in the base that is configured to accept the horizontal alignment element. The container and receiving tray are configured such that downward motion of the container with the shaped surface of the housing in contact with the redirection feature of the base induces a lateral motion of the container according to the engagement of the shaped surface and the redirection feature that causes the horizontal alignment element to slide into the horizontal alignment hole.

A removable container for removable insertion into a receiving tray is disclosed. The removable container includes a housing having at least one shaped surface and at least one horizontal alignment element coupled to and projecting from the housing. The shaped surface is configured to engage a redirection feature of the receiving tray such that downward motion of the container induces a lateral motion of the container according to the engagement of the shaped surface and the redirection feature that causes the horizontal alignment element to slide into a horizontal alignment hole in the receiving tray that is configured to accept the alignment element.

A receiving tray for accepting a removable container having a shaped surface and one or more horizontal alignment elements is disclosed. The receiving tray includes a base having a redirection feature and at least one horizontal alignment hole in the base that is configured to accept the horizontal alignment element. The redirection feature is configured to engage the shaped surface of the removable container such that downward motion of the container induces a lateral motion of the container according to the engagement of the shaped surface and the redirection feature that slides the horizontal alignment element into the horizontal alignment hole.

A method for converting a vertical insertion motion into a lateral motion is disclosed. The method includes the steps of positioning a container having a shaped surface and at least one horizontal alignment element above a receiving tray having a redirection feature and at least one horizontal alignment hole, and inserting the container vertically downward into the receiving tray such that the shaped surface contacts the redirection feature. The method also includes the steps of allowing the container to move laterally according to the engagement of the shaped surface and the redirection feature as the container continues to move downward, and guiding the horizontal alignment element into the horizontal alignment hole as the container moves laterally.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

The following description discloses embodiments of a container having horizontal and vertical alignment elements and a shaped surface that engages a redirection feature of a receiving tray such that a downward vertical motion of the container relative to the receiving tray induces a lateral motion of the container that engages the horizontal alignment features with horizontal alignment holes in the receiving tray. These features allow the user to vertically insert the container into the receiving tray while providing a horizontal engagement with the receiving tray that restrains the vertical motion of the container.

In the following detailed description, numerous specific details are set forth to provide a full understanding of the present disclosure. It will be apparent, however, to one ordinarily skilled in the art that embodiments of the present disclosure may be practiced without some of the specific details. In other instances, well-known structures and techniques have not been shown in detail so as not to obscure the disclosure.

The method and system disclosed herein are presented in terms of a container adapted to contain medications and to be inserted into a drawer in an ADM. It will be obvious to those of ordinary skill in the art that this same configuration and method can be utilized in a variety of applications. Nothing in this disclosure should be interpreted, unless specifically stated as such, to limit the application of any method or system disclosed herein to a medical environment or to the dispensing of medications.

Figure 1:
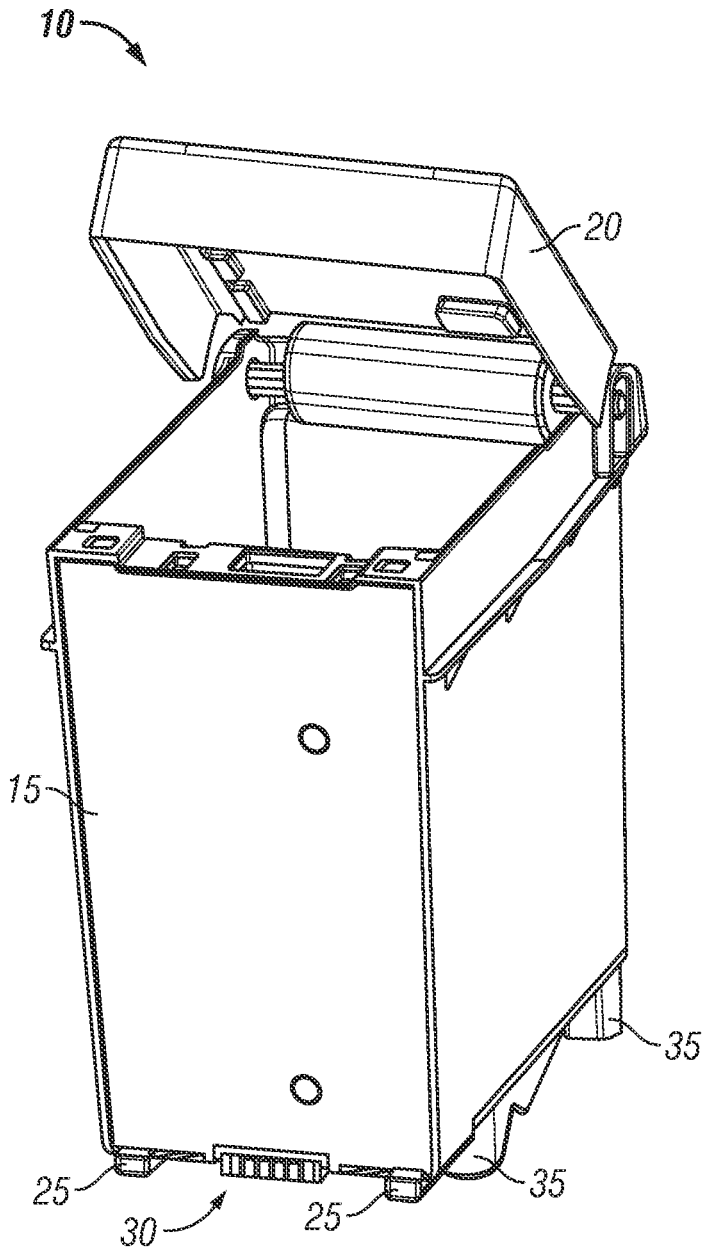
FIG. 1 is a perspective view of a container according to certain aspects of this disclosure.

FIG. 1 is a perspective view of a container 10 according to certain aspects of this disclosure. The container 10 comprises a housing 15 and a lid 20 that is hingedly attached to housing 15. The housing 15 has feet 35 (e.g. four feet) on its bottom 15A so that the container 10, which has various mechanical features (not shown) on the underside of the housing 15 will sit flat and stably on a horizontal surface. When the lid 20 is closed, it is retained in the closed position by a latching mechanism (not shown) such that the contents cannot be accessed except when the container 10 is connected to an external system. In certain embodiments, container 10 is connected to a loading station in the pharmacy and opened, whereupon a quantity of a medication is placed in the container 10. The lid 20 is then closed and the container 10 removed from the loading station and transported to an ADM where the container 10 is installed in a drawer that contains a receiving tray configured to accept the container 10. The contents of container 10 are then available to caregivers who are authorized to open the container 10 by the ADM and the hospital data system.

The container 10 has horizontal alignment features 25 and connector 30 that will be described in more detail with respect to other figures.

Figure 2:
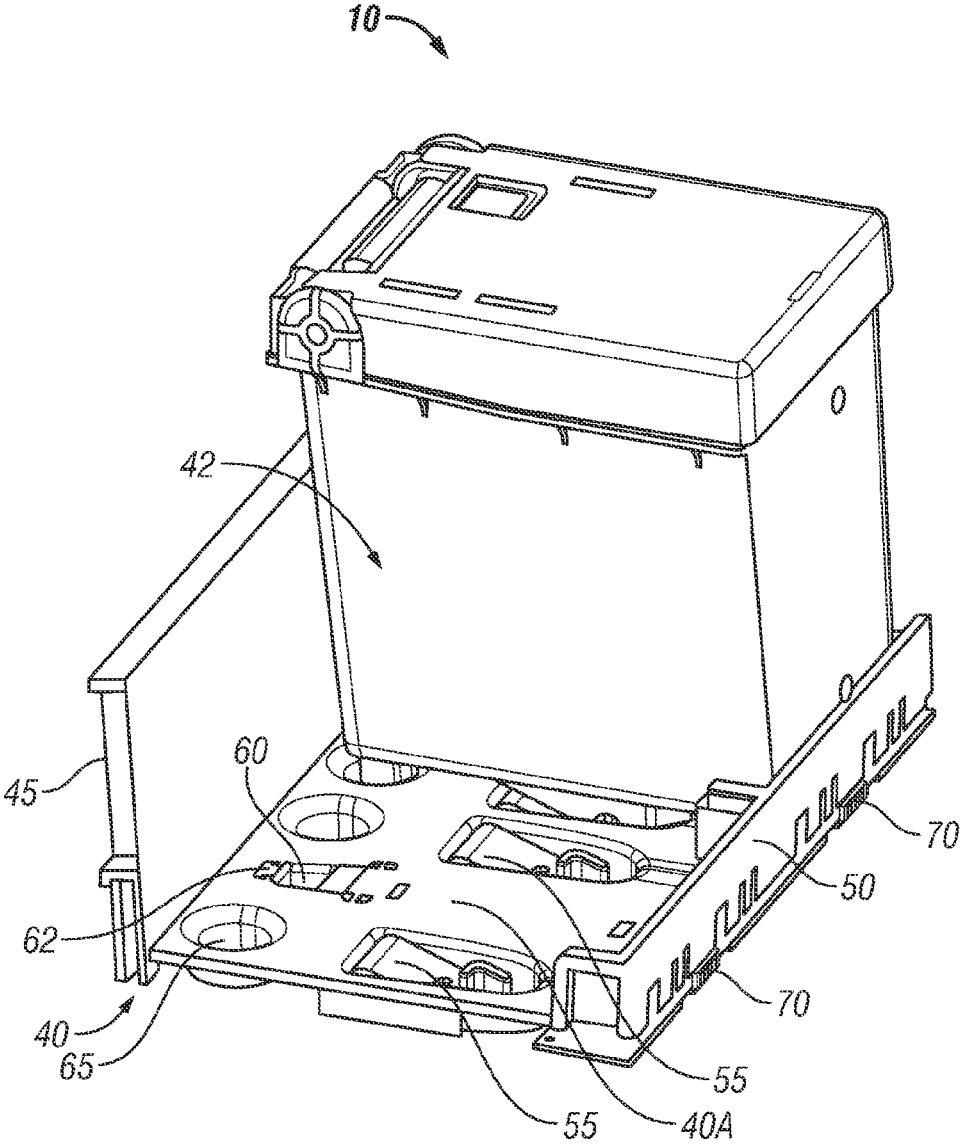
FIG. 2 is a perspective view of a container fully inserted into a receiving tray according to certain aspects of this disclosure.

FIG. 2 is a perspective view of a container 10 fully inserted into a receiving tray 40 according to certain aspects of this disclosure. The receiving tray 40 of FIG. 2 is configured to receive a plurality of containers 10 in adjacent docking locations 42. The receiving tray 40, in this embodiment, includes a back wall 45 and a front wall 50 that assist the user in placing the container 10 in the proper location. The receiving tray 40 has foot recesses 65 located such that the feet 35 of the housing 15 are located in the foot recesses when the container 10 is fully inserted into the receiving tray 40. This allows the mechanical features (not shown) on the underside of housing 15 to engage features of the receiving tray 40. The receiving tray 40 also includes, in this exemplary illustrated embodiment, two lifters 55 for each docking location 42. The design and operation of lifters 55 are discussed in more detail in relation to FIGS. 3A and 3B. The receiving tray 40 also includes a connector 70 that is positioned and configured to engage the connector 30 of the container 10 when the container 10 is in the fully inserted position with respect to the receiving tray 40. The receiving tray 40 also includes a hook alignment recess 60 that is positioned and configured to accept a hook (not shown) on the housing 15. The back edge of the hook alignment recess 60 is a redirection feature 62. An exemplary design and operation of the hook alignment recess 60 and the redirection feature 62 are discussed in more detail in relation to FIGS. 5A-5C and 6.

Figure 3A:
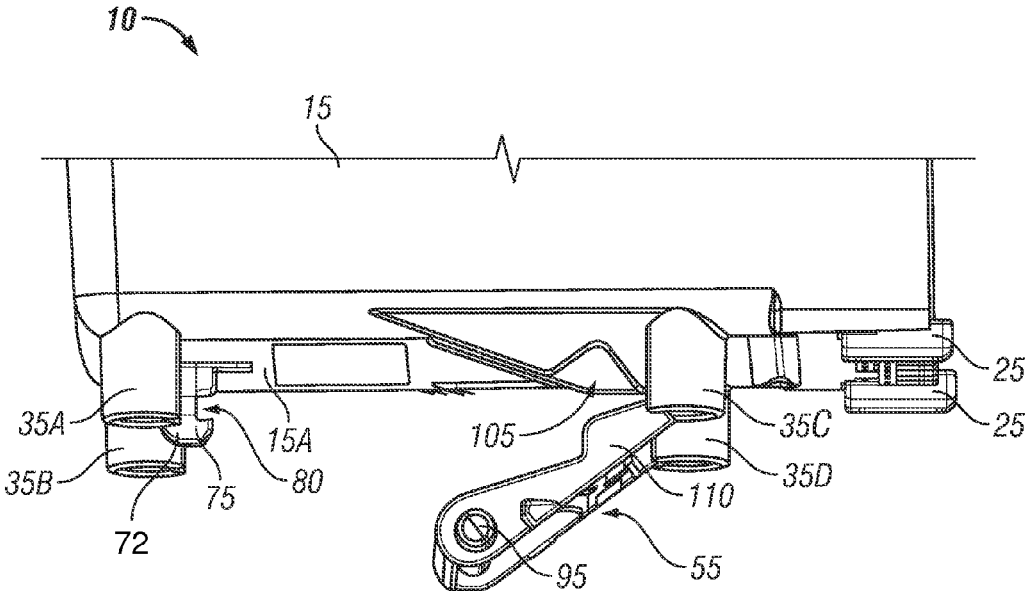
FIGS. 3A-3B are perspective views of the lifters of a receiving tray and the pockets on the housing of a container according to certain aspects of this disclosure.
Figure 3B:
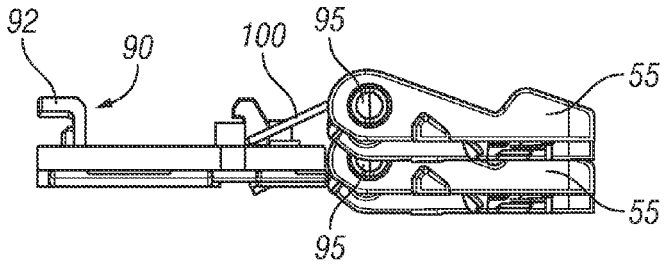

FIGS. 3A-3B are perspective views of the lifters 55 of a receiving tray 40 and the pockets 105 on the housing 15 of the container 10 according to certain aspects of this disclosure. FIG. 3A shows the underside of the housing 15 wherein the feet 35 are visible in the corners of the housing bottom 15A, with two horizontal alignment features 25 at the front edge of the bottom 15A of the housing 15 and projecting forward from the housing 15. At the rear of housing 15 and between the rear feet 35*a*, 35*b* is a hook 75 that is, in certain embodiments, formed as a part of the housing 15 and projecting downward from the bottom 15A. The hook 75 has a retention feature 80 on the front side and a shaped surface 70 on the back side. The design and operation of the shaped surface 70 in conjunction with the redirection feature 62 is discussed in more detail in relation to FIGS. 5A-5C. Adjacent to the front pair of feet 35 are two walls that have pockets 105 on their underside. A single lifter 55 is shown in FIG. 3A in a raised position, i.e. with the arm 110 that extends from the pivot 95 in a position where the arm 110 is at an angle to the top surface 40A of the receiving tray 40 (not shown in FIG. 3A) that is, in this embodiment approximately 45 degrees. The arm 110 is configured to rotate about the pivot 95 over a limited range of motion between this first position seen in FIG. 3A and a second position, seen in FIG. 3B, where the arms 110 lie flat and parallel to the top surface 40A of receiving tray 40 (not shown). It can be seen that the lifter 55 has a profile that will engage the pocket 105 of the housing 15 as the container 10 is inserted vertically downward into the receiving tray 40.

FIG. 3B depicts the latching element 90, the two lifters 55, and two biasing elements 100 that are part of the receiving tray 40. The receiving tray 40 itself is not shown so as to reveal these components, which are shown in their proper relative position to each other. These elements are all located below the top surface 40A of the receiving tray 40 when in this position. The latching element 90 includes a flat tab 92 that protrudes into the hook alignment recess 60 that is visible in FIG. 2 such that the tab 92 engages the retention feature 80 of the hook 75 when the hook 75 descends into the hook alignment recess 60 as the container 10 is inserted into the receiving tray 40. The retention feature 80 is retained by the latching element 90 that is urged by a biasing element (not shown) to move toward the rear to engage the retention element 80. The latching element 90, in this embodiment, is configured to release the retention feature 80 by move toward the front (to the right in FIG. 3B) when acted upon by an unlatching actuator (not shown).

In FIG. 3B, the lifters 55 are shown in the second position wherein the lifters 55 are parallel with the top surface 40A of the receiving tray 40 and located within recesses in the receiving tray 40 such that the tops of the lifters 55 are flush or below the top surface 40A of the receiving tray 40 as shown in FIG. 2. The biasing elements 100, partially hidden behind one of the lifters 55, are, in this embodiment, torsion springs that are wrapped around the pivot 95. One end of a biasing element 100 engages a lifter 55 and the other end of the biasing element 100 engages the receiving tray 40, applying a biasing force that urges the lifter 55 to rotate away from the second position of FIG. 3B and toward the first position of FIG. 3A.

Figure 4:
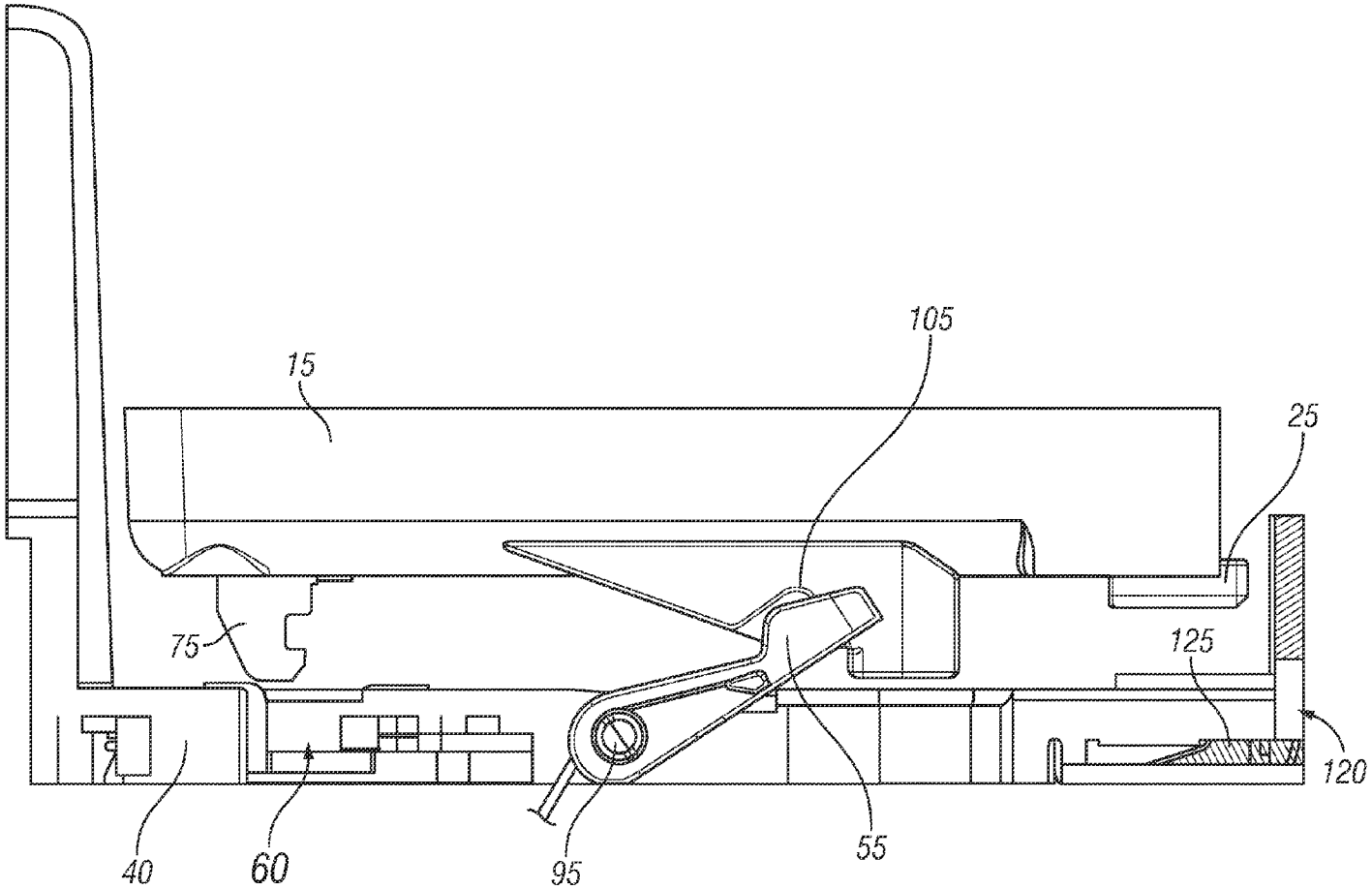
FIG. 4 is a cross-section of the lower portion of a container and a receiving tray according to certain aspects of this disclosure.

FIG. 4 is a cross-section of the lower portion of the container 10 and the receiving tray 40 according to certain aspects of this disclosure. Upon initial vertical downward insertion of container 10 into receiving tray 40, the hook 75 rests on the top surface 40A of the receiving tray 40 just to the rear of the hook alignment recess 60. The housing 15 is still horizontal and the horizontal alignment features 25 are positioned above a alignment notch 125 that is connected to the horizontal alignment holes 120. The lifters 55 can be seen to be extended from the pivot 95 in the first raised position of FIG. 3A and engaged with the pockets 105 of the housing 15.

Figure 5A:
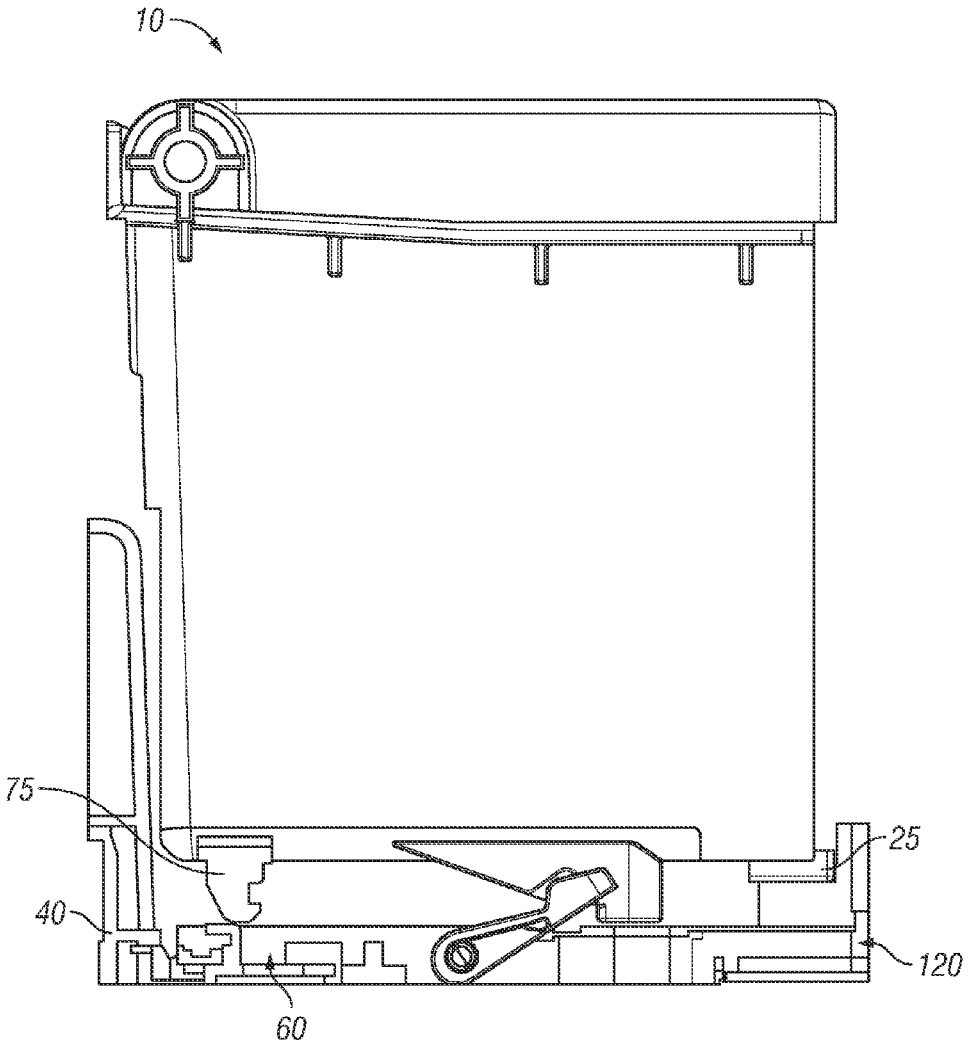
FIGS. 5A-5C form a sequence of views showing the insertion of a container into a receiving tray according to certain aspects of this disclosure.
Figure 5B:
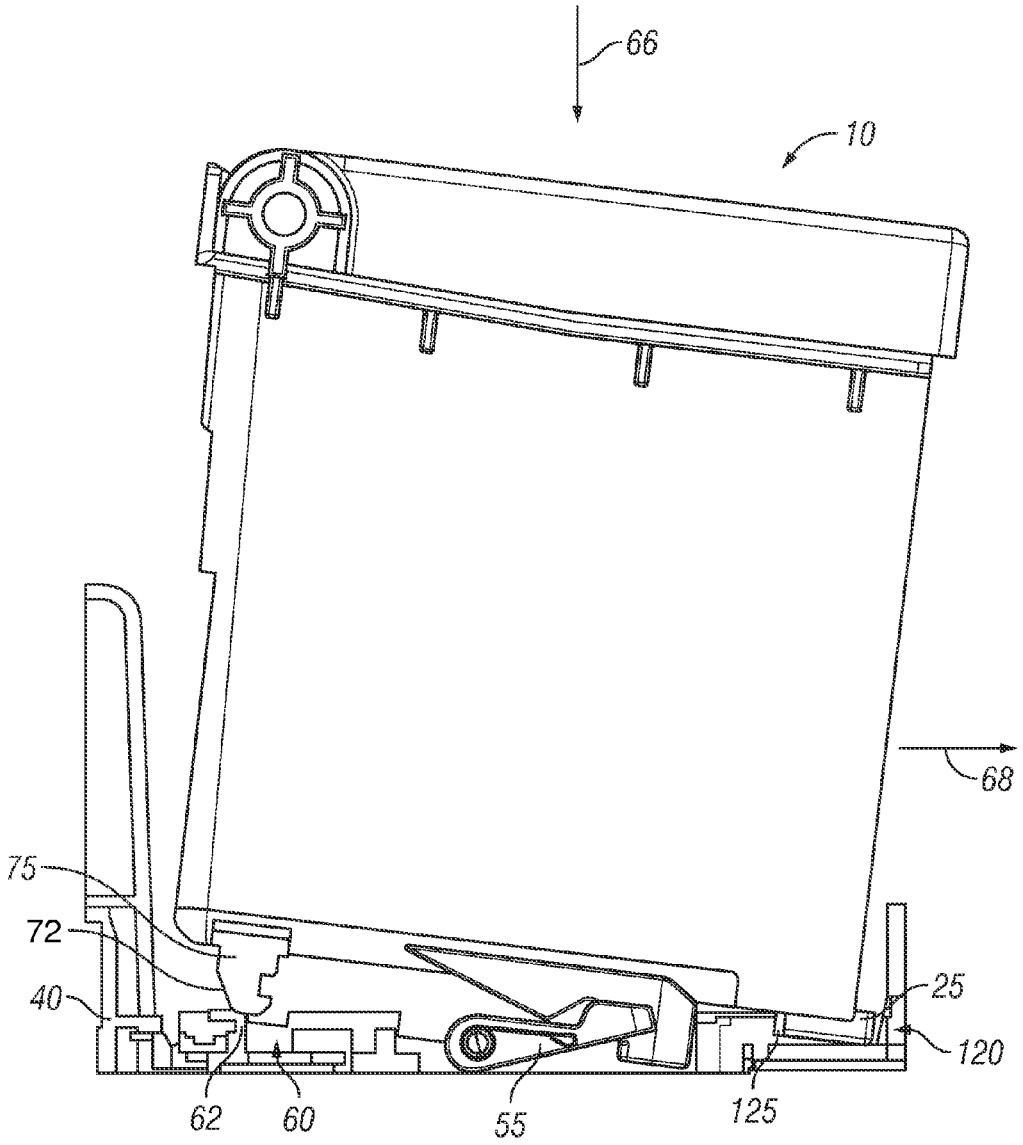
Figure 5C:
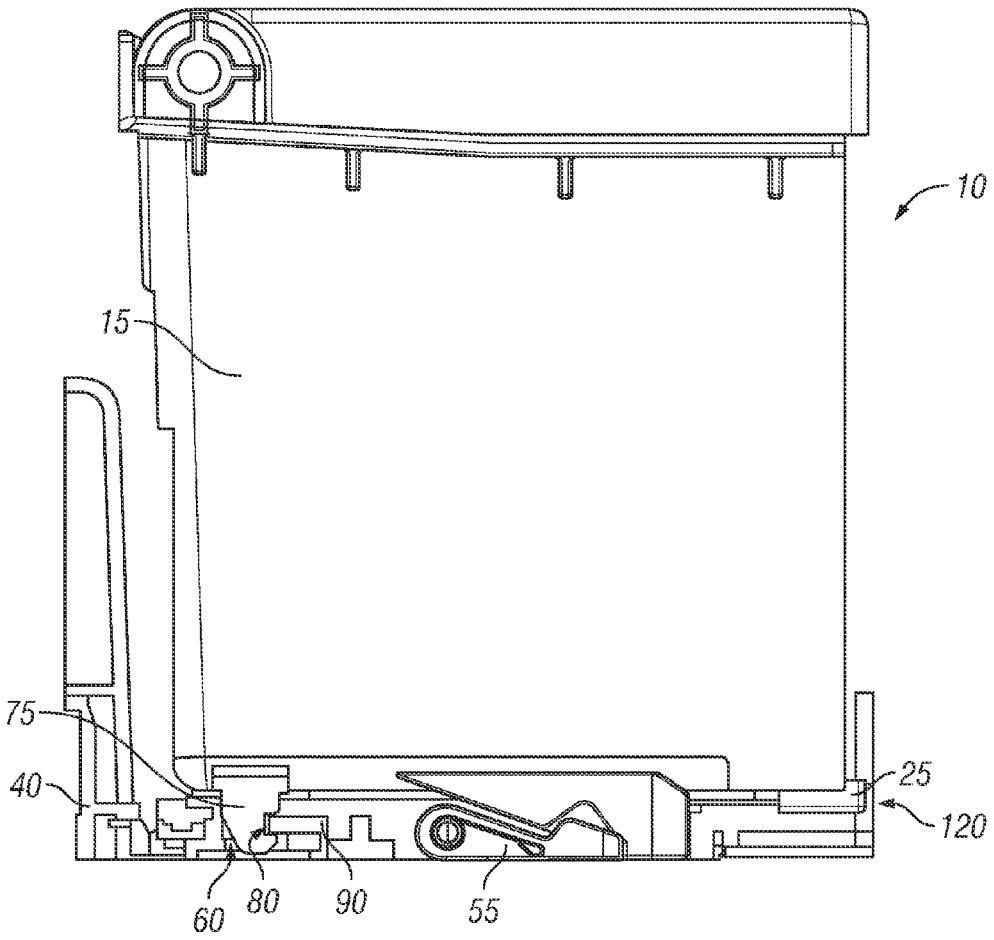

FIGS. 5A-5C form a sequence of views showing the insertion of a container 10 into a receiving tray 40 according to certain aspects of this disclosure. FIG. 5A is the same position and configuration as shown in FIG. 4, wherein FIG. 4 was a closer view of the lower portion of the container 10 but now shown in its entirety. The hook 75 is resting on the top surface 40A of the receiving tray just to the rear of the hook alignment recess 60 and the horizontal alignment features 25 are positioned above the horizontal alignment holes 120.

In FIG. 5B, the container 10 has rotated forward, clockwise in the view of FIG. 5B, as it is pushed down, due to interaction between the lifters 55 and the pockets 105 and moved forward such that the shaped surface 70 of the hook 75 is now in contact with the redirection feature 62 that forms the back edge of the hook alignment recess 60. Also, the horizontal alignment features 25 are now in contact with the alignment notches 125. The angle of the shaped surface 70 and the configuration of the redirection feature 62 are such that additional downward force 66 will create a lateral force 68 that will cause the container to move toward the front of receiving tray 40 as the hook 75 descends further into the hook alignment recess 60. This lateral motion will cause the horizontal alignment features 25, which are in contact with the alignment notches 125 and positioned in front of the horizontal alignment holes 120, to slide into the horizontal alignment holes 120. Lifters 55 provide additional guidance of the conversion of the vertical force into a horizontal motion as the lifers 55 pivot during the insertion.

FIG. 5C depicts the final fully inserted position of container 10 into receiving tray 40. The hook 75 is fully inserted into the hook alignment recess 60 and the latching element 90 has engaged the retention feature 80 of the hook 75. The horizontal alignment features 25 are inserted into the horizontal alignment holes 120. The lifter 55 is in its second position and nominally flush with the top surface 40A of the receiving tray 40. The housing 15 is resting on the top surface 40A of the receiving tray 40 and the container 10 has rotated back to being parallel to the top surface 40A of the receiving tray 40. In this position, the engagement of the horizontal alignment features 25 in the horizontal alignment holes 120 restrains the container 10 from vertical motion that degrades the reliability of the electrical connectors 30 and 70. The hook 75 can be seen to be fully engaged by the latching element 90 and constrained by the hook alignment recess 60, preventing the container from moving laterally or rotationally about the front edge. The details of the engagement between the arm 110 and the pocket 105 are visible herein and it can be seen how the inclined surfaces of arm 110 and pocket 105 will interact such that a clockwise, in the view of FIG. 6, rotation of the lifter 55 will induce an upward and lateral motion of container 10.

Upon release of the retention feature 80 by the latching element 90, the biasing element 100 will cause the lifters 55 to apply a force to the pockets 105 of the housing 15. The shape of the arms 110 and the pockets 105 cooperate to convert this applied force to a lateral rearward force as well as an upward force that causes the container to move to the rear and upward. This motion disengages the horizontal alignment features 25 from the horizontal alignment holes 120 and also the hook 75 from the hook alignment recess 60, thus reversing the sequence of FIGS. 5A to 5C, such that the container 10 is returned to the configuration of FIG. 5B placing the container in a higher position to present better exposure of the upper portion of the container to facilitate vertical removal from the receiving tray 40 by the user.

Figure 6:
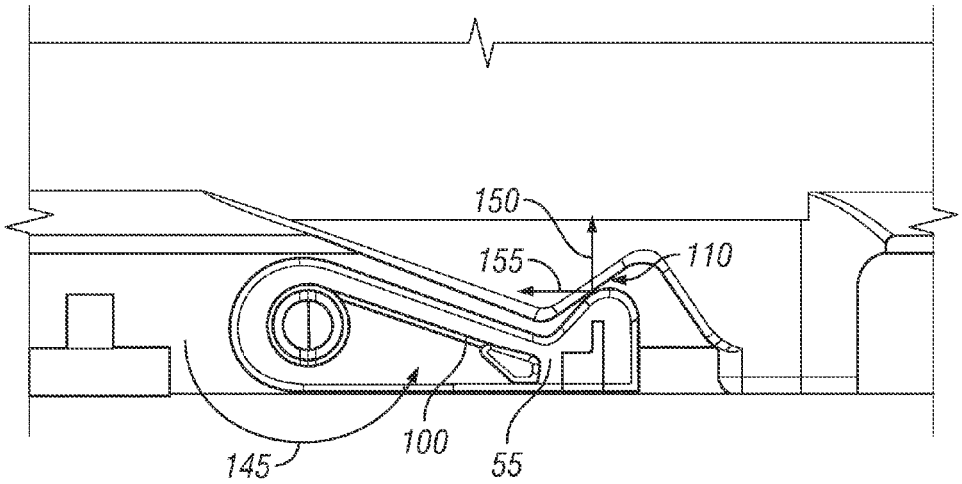
FIG. 6 is a diagram showing the forces applied by the lifter to the pocket of the container according to certain aspects of this disclosure.

FIG. 6 is a diagram showing the forces applied by the lifter 55 to the pocket 105 of the container 10 according to certain aspects of this disclosure. The torque 145 applied by the biasing element 100 to the lifter 55 creates two force components 150 and 155 at the point of contact between the lifter 55 and the pocket 105. While the hook 75 is engaged, the rearward force 155 biases the container against the rear of the hook alignment recess 60 thereby reducing the relative horizontal motion, and therefore the wear, between the connector half of the container 10 and the connector half on the receiving tray 40. When the hook 75 is released by the latching element 90, these forces 150 and 155 will cause the container 10 to move laterally rearward and upward.

Hence, using the features described above, a user can insert a container 10 into a drawer, or other compartment or storage location, having a receiving tray 42 with a downward push on the container 10, and the redirection feature 62 will cause the container 10 to properly move laterally and engage the alignment features that restrain the container 10.

Figure 7:
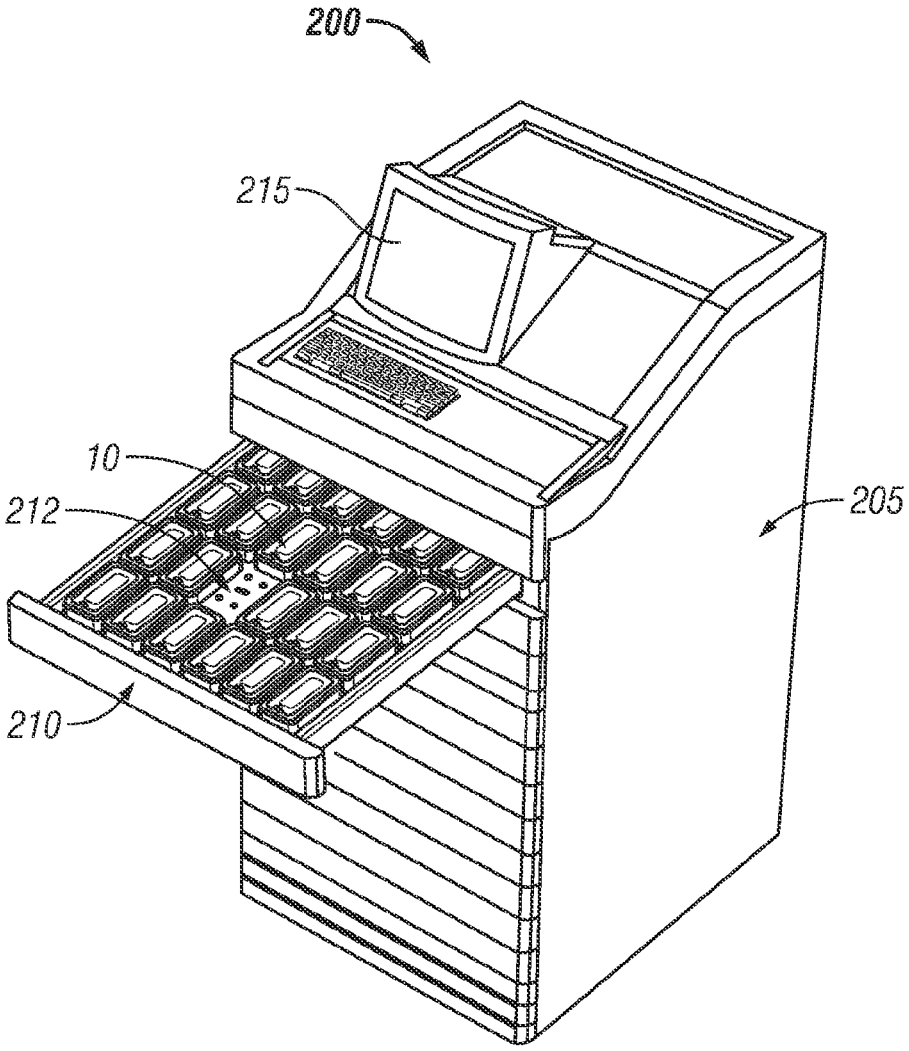
FIG. 7 illustrates an exemplary ADM that includes removable containers and receiver trays according to certain aspects of this disclosure.

FIG. 7 illustrates an exemplary ADM 200 that includes removable containers 10 and receiving trays 40 according to certain aspects of this disclosure. The ADM 200 includes a cabinet 205 with a controller 215 that is, in this example, housed in the top structure of the ADM 200. The controller 215 includes a processor with a memory (not shown), a display, a keyboard and touchscreen input devices, a power supply (not shown), and communication modules (not shown) that couple the processor to the internal components of the ADM 200 and to external networks and systems. In certain embodiments, the ADM 200 includes a barcode scanner (not shown) that is fixedly or removably mounted to the top structure or cabinet 205. The ADM 200 also includes a drawer 210 that is configured to accept the containers 10 from FIG. 1, wherein the drawer 210 contains one or more receiving trays 40 that are configured to accept the containers 10. The drawer 210 has multiple locations 42 configured to accept a container 10. In certain embodiments, the receiving tray is attached to fixed parts of the cabinet 205, such as a shelf or inclined surface (not shown). In certain embodiments, containers 10 are available in a plurality of widths, such as a double-wide (2×) size that is twice the width of the container 10 of FIG. 1 and occupies two adjacent docking locations 42 of the receiving tray 40 of FIG. 2. In certain embodiments, other incremental widths of container 10 are available, including 3×, 4×, and so on to the maximum number of adjacent docking locations 42 of a receiving tray 40 in a drawer 210. In certain embodiments, the cabinet 105 is a smaller structure having only a few drawers 110, wherein the storage capacity of the ADM 200 is suitable for a single patient rather than a plurality of patients. In certain embodiments, the cabinet 205 is mounted to and supported by a wall.

In summary, the disclosed self-guiding insertion and biasing mechanism enables the use of horizontal alignment, positioning, and biasing features that provide improved alignment and stability of the relative positions of the electrical connectors of the container and receiving tray that improves the performance and life of the connectors. This is accomplished while still providing the vertical insertion motion that is preferred by users, so that the users are not required to manipulate the containers into engagement with the receiving tray, without the loss of valuable productive space within the ADM. Embodiments of the disclosed arrangement further provide for disengaging the horizontal alignment features and elevating the container upon a command to release the container from the drawer, thereby simplifying the removal process and the identification of the container that is to be removed.

The previous description is provided to enable a person of ordinary skill in the art to practice the various aspects described herein. While the foregoing has described what are considered to be the best mode and/or other examples, it is understood that various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the terms "a set" and "some" refer to one or more. Pronouns in the masculine (e.g., his) include the feminine and neuter gender (e.g., her and its) and vice versa. Headings and subheadings, if any, are used for convenience only and do not limit the invention.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A drawer assembly comprising:

a removable container comprising a pocket having a sloped surface angled toward a first direction askew from a direction of a bottom surface of the removable container; and a receiving tray comprising a base, a first wall, a second wall, and a lifter rotatably coupled to the base at a pivot attached to the base, the first wall having a greater height than the second wall, the lifter having a lifter arm extending from the pivot and having a surface angled toward a second direction, opposite the first direction, wherein the lifter has a first position with the lifter arm extending upward from the base at a first angle to the base and a second position with the lifter arm extending at a second angle to the base that is less than the first angle, the lifter arm (a) being biased to move from the second position toward the first position, and (b) being in the second position, and the surface of the lifter arm engaging the sloped surface, when the removable container is in a fully inserted position in the receiving tray.

2. The drawer assembly of claim 1, wherein the receiving tray further comprises a biasing element coupled to the lifter, the biasing element configured to urge the lifter to rotate away from the second position and toward the first position.

3. The drawer assembly of claim 2, wherein:

the removable container further comprises a hook coupled to and projecting from the removable container, the hook comprising a retention feature and a shaped surface;

the receiving tray further comprises a redirection feature, a hook alignment aperture in the base, and a latching element protruding into the hook alignment aperture;

interaction of the shaped surface of the hook with the redirection feature of the receiving tray causes the removable container to move laterally as the housing is inserted into the receiving tray;

the hook alignment aperture is configured such that the hook enters the hook alignment aperture as the horizontal alignment element enters the horizontal alignment hole; and the latching element is configured to engage the retention feature when the housing is in the fully inserted position.

4. The drawer assembly of claim 2, wherein the biasing element comprises a torsion spring.

5. The drawer assembly of claim 1, wherein the removable container comprises a first connector half, the base comprises a second connector half, and the first connector half contacts the second connector half when the removable container is in the fully inserted position.

6. The drawer assembly of claim 5, wherein:

the first connector half and the second connector half are in electrical contact when the housing is in the fully inserted position.

7. The drawer assembly of claim 1, wherein as the lifter arm rotatably moves from the second position to the first position, the lifter arm applies an upward force and a horizontal force on the removable housing.

8. The drawer assembly of claim 7, wherein as the lifter arm rotatably moves from the second position to the first position, the removable housing is drawn in the second direction.

9. The drawer assembly of claim 1, wherein the lifter arm is positioned within a recess of the base.

10. The drawer assembly of claim 1, wherein the lifter arm is configured to rotate about forty-five degrees from the second position to the first position.

11. The drawer assembly of claim 1, wherein the pivot is positioned beneath a top surface of the base.

12. A drawer assembly comprising:

a removable housing comprising (a) a pocket having a sloped surface that extends askew from a forward direction, and (b) a bottom surface; and a receiving tray comprising:

a base comprising a top surface, wherein the bottom surface of the removable housing contacts the top surface when the housing is in a fully inserted position on the receiving tray;

a forward facing wall at a first edge of the base and a second wall at a second edge of the base, the forward facing wall having a greater height than the second wall, the second edge opposite the first edge; and a lifter arm rotatably coupled to the base at a pivot attached to the base and beneath the top surface, the lifter arm having a surface extending askew from a backward direction, opposite the forward direction, and the lifter arm having a first position extending upward from the top surface at a first angle to the top surface and a second position with the lifter arm extending parallel to the top surface and within a recess of the base;

wherein when the removable housing is locked in the fully inserted position on the receiving tray, the lifter arm is in the second position and the lifter arm surface facing askew from the backward direction engages a portion of the sloped surface that extends askew from the forward direction and imparts a rearward and upward force against the sloped surface.

13. The drawer assembly of claim 12, wherein when the removable housing is locked in the fully inserted position on the receiving tray the removable housing is moved rearward against the forward-facing wall of the base, thereby limiting motion of the removable housing in the forward and rearward directions relative to the base.

14. The drawer assembly of claim 12, wherein the removable housing further comprises a horizontal alignment element projecting in the forward direction from the housing, the base further comprises a horizontal alignment hole configured to receive the horizontal alignment element, and wherein when the lifter arm rotates from the second position to the first position, the lifter arm moves the removable housing rearward and upward such that the horizontal alignment element is released from the horizontal alignment hole.

15. The drawer assembly of claim 12, wherein the receiving tray further comprises a biasing element coupled to the lifter arm, the biasing element configured to urge the lifter arm to rotate away from the second position and toward the first position.

16. The drawer assembly of claim 15, wherein the biasing element comprises a torsion spring.

17. The drawer assembly of claim 12, wherein:

the removable housing further comprises a hook projecting from the bottom surface, the hook comprising a retention feature and a shaped surface;

the receiving tray further comprises a redirection feature, a hook alignment aperture in the base that comprises the forward-facing wall, and a latching element protruding into the hook alignment aperture;

interaction of the shaped surface of the hook with the redirection feature of the receiving tray causes the housing to move forward as the housing is inserted into the receiving tray;

the hook alignment aperture is configured such that the hook enters the hook alignment aperture as the horizontal alignment element enters the horizontal alignment hole; and the latching element is configured to engage the retention feature when the housing is in the fully inserted position.

18. The drawer assembly of claim 12, wherein the removable housing comprises a first connector and the receiving tray comprises a second connector, the first and second connectors being configured to be in electrical contact when the removable housing is in the fully inserted position.

19. A method comprising the steps of:

positioning a container, comprising (i) a horizontal alignment element projecting from the container in a first direction, and (ii) a pocket with a sloped surface extending upward and askew from the first direction, above a receiving tray having a horizontal alignment hole and a lifter, wherein the receiving tray comprises a base, a first wall, and a second wall, the first wall having a greater height than the second wall;

inserting the container vertically downward, thereby engaging a lifter arm of the lifter with the sloped surface of the pocket such that the lifter moves away from a first position to a second position associated with a fully inserted position of the container as the interaction of the receiving tray and the container causes the container to move in the first direction so as to insert the horizontal alignment element into the horizontal alignment hole, wherein the lifter arm has a surface extending at an angle corresponding to the sloped surface of the pocket, and the lifter arm is biased to move from the second position toward the first position such that the surface of the lifter arm engages the sloped surface of the pocket when the lifter arm is in the second position and applies, as the container is locked in the fully inserted position, a bias force to the container, thereby limiting motion of the container in the first direction and a second direction opposite the first direction with respect to the base when the container is in the fully inserted position; and engaging a retention feature of the container with a latching element of the receiving tray when the container is in the fully inserted position.

20. The method of claim 19, further comprising releasing the retention feature thereby permitting the lifter arm to rotate from the second position to the first position to move the container rearward and upward such that the horizontal alignment element is released from the horizontal alignment hole.

* * * * *